US005884293A

United States Patent [19]

Herbert

[11] Patent Number: 5,884,293

[45] Date of Patent: Mar. 16, 1999

[54] POSTAGE METER AND METHOD OF FORMING FRANKING INDICIA ON MAIL

[75] Inventor: Raymond John Herbert, Leigh-on-Sea, United Kingdom

[73] Assignee: Neopost Limited, Essex, United Kingdom

[21] Appl. No.: 792,427

[22] Filed: Jan. 30, 1997

[30] Foreign Application Priority Data

Jan. 31, 1996 [GB] United Kingdom ..... 9601897

[51] Int. Cl.[6] ..... B41J 2/435; B41J 2/47; G07B 17/00

[52] U.S. Cl. ..... 705/408; 101/71; 347/179; 347/224

[58] Field of Search ..... 101/71; 347/179, 347/224, 225; 705/401, 408

[56] References Cited

U.S. PATENT DOCUMENTS 4,673,303 6/1987 Sansone et al. ..... 400/126

FOREIGN PATENT DOCUMENTS 2092957 8/1982 United Kingdom .

2269343 2/1994 United Kingdom .

*Primary Examiner*—Edward R. Cosimano

*Attorney, Agent, or Firm*—Shoemaker and Mattare, Ltd.

[57] ABSTRACT

Apparatus and a method of forming a franking indicium on a mail item is disclosed. An area of ink is deposited on the mail item at a first station and at a second station the deposited ink is selectively removed to leave a required franking indicium on the mail item. The removal of the deposited ink may be effected by scanning the area with a laser beam and switching the laser beam on to impinge on and remove unrequired portions of the area of ink and switching the laser beam off when the scanning would otherwise cause the laser beam to impinge on portions of the area of ink required to form the franking indicium.

12 Claims, 2 Drawing Sheets

POSTAGE METER AND METHOD OF FORMING FRANKING INDICIA ON MAIL

BACKGROUND OF THE INVENTION

This invention relates to postage meters and in particular to methods and apparatus for forming franking indicia on items.

Known postage meters for franking mail items include accounting means to carry out accounting functions in respect of postage charges dispensed by the meter and a printer to print a franking impression on each mail item to indicate that a postage charge has been applied to the item and has been charged to the account of the user of the postage meter. Earlier postage meters incorporated a drum printer to print the franking impression. The drum printer comprises a rotatable print drum carrying a fixed printing die to print invariable parts of the impression sets of print wheels which are set to print a required value of postage charge and the date on which the printing effected. In more recent developments of postage meters the rotatable print drum has been replaced by electronic digital printing devices. These digital printing devices comprise means to print dots selectively in a matrix of positions on the mail item so as to form a required impression.

SUMMARIES OF THE INVENTION

According to a first aspect of the invention a postage meter includes electronic accounting and control means and indicium pattern forming means operable by said electronic accounting and control means to form a required franking indicium on a mail item; said indicium pattern forming means including means to deposit an area of ink on the mail item and laser means operable to remove portions of said area of ink to leave ink forming the required franking indicium on the mail item.

According to a second aspect of the invention a method of forming a franking indicium on a mail item includes the steps of depositing an area of ink on a surface of the mail item; and subjecting the area of ink to an ink removal step in which unwanted ink is removed from the surface of the mail item to leave a franking indicium remaining on the surface of the mail item.

BRIEF DESCRIPTION OF THE DRAWING

An embodiment of the invention will now be described by way of example with reference to the drawings in which.

DESCRIPTION OF THE PREFERRED EMBODIMENT

Figure 1:
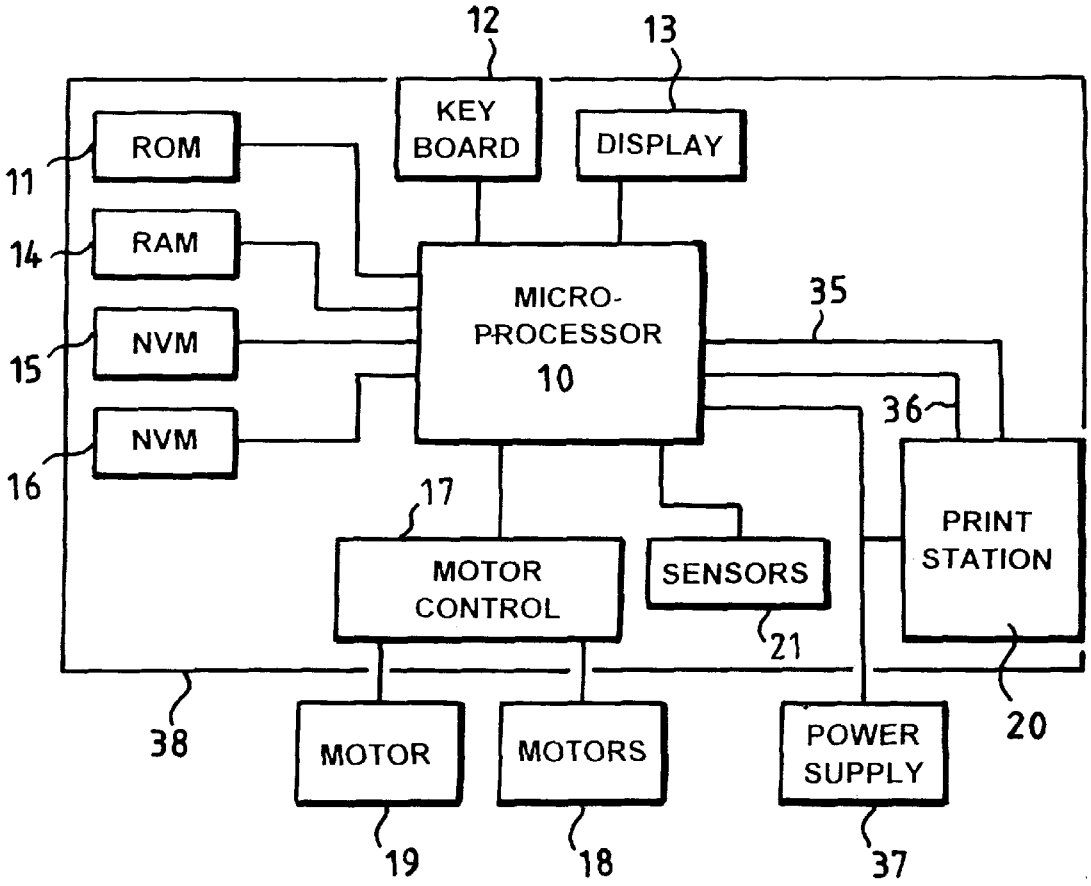
FIG. 1 is a block diagram of a postage meter.

Referring first to FIG. 1, the postage meter includes electronic accounting and control means comprising a micro-processor 10 operating under program routines stored in a read only memory (ROM) 11. A keyboard 12 is provided for input of commands and data by a user and a display 13 is provided to enable display of information to the user. A random access memory (RAM) 14 is provided for use as a working store for storage of temporary data during operation of the postage meter. Non-volatile duplicated memories 15, 16 are provided for the storage of critical data relating to use of the postage meter and which is required to be retained even when the postage meter is not powered. The micro-processor 10 carries out accounting functions in relation to use of the postage meter for franking mail items with postage charges applicable to handling of the mail items by the postal authority or another carrier. Accounting data relating to use of the postage meter for printing franking impressions representing postage charges for mail items and any other critical data to be retained is stored in the non-volatile memories 15, 16. The accounting data includes a value of credit available for use by the meter in franking mail items, an accumulated total of value used by the meter in franking mail items, a count of the number of mail items franked by the meter and a count of the number of mail items franked with a postage charge in excess of a predetermined value. The value of credit is stored in a descending credit register, the accumulated total value is stored in an ascending tote register, the count of items is stored in an items register and the count of items franked with a postage charge in excess of a predetermined value is stored in a large items register. As is well known in the postage meter art, each of the registers referred to hereinbefore for storing accounting data is replicated in order to enable integrity of the accounting data to be maintained even in the event of a fault or termination of power to the meter during a franking operation. Two replications of each of the registers are provided in each of the memory devices 15, 16.

A motor controller 17 is controlled by the microprocessor 10 to control operation of motors 18, 19 driving feeding means for feeding a mail item through a printing station and driving an element of the printing station 20. One or more sensors 21 are provided to enable the microprocessor 10 to monitor the speed of the mail item and the element of the printing station driven by motors 18 and 19 respectively. Components of the postage meter required to be maintained secure are housed in a secure housing 38.

Figure 2:
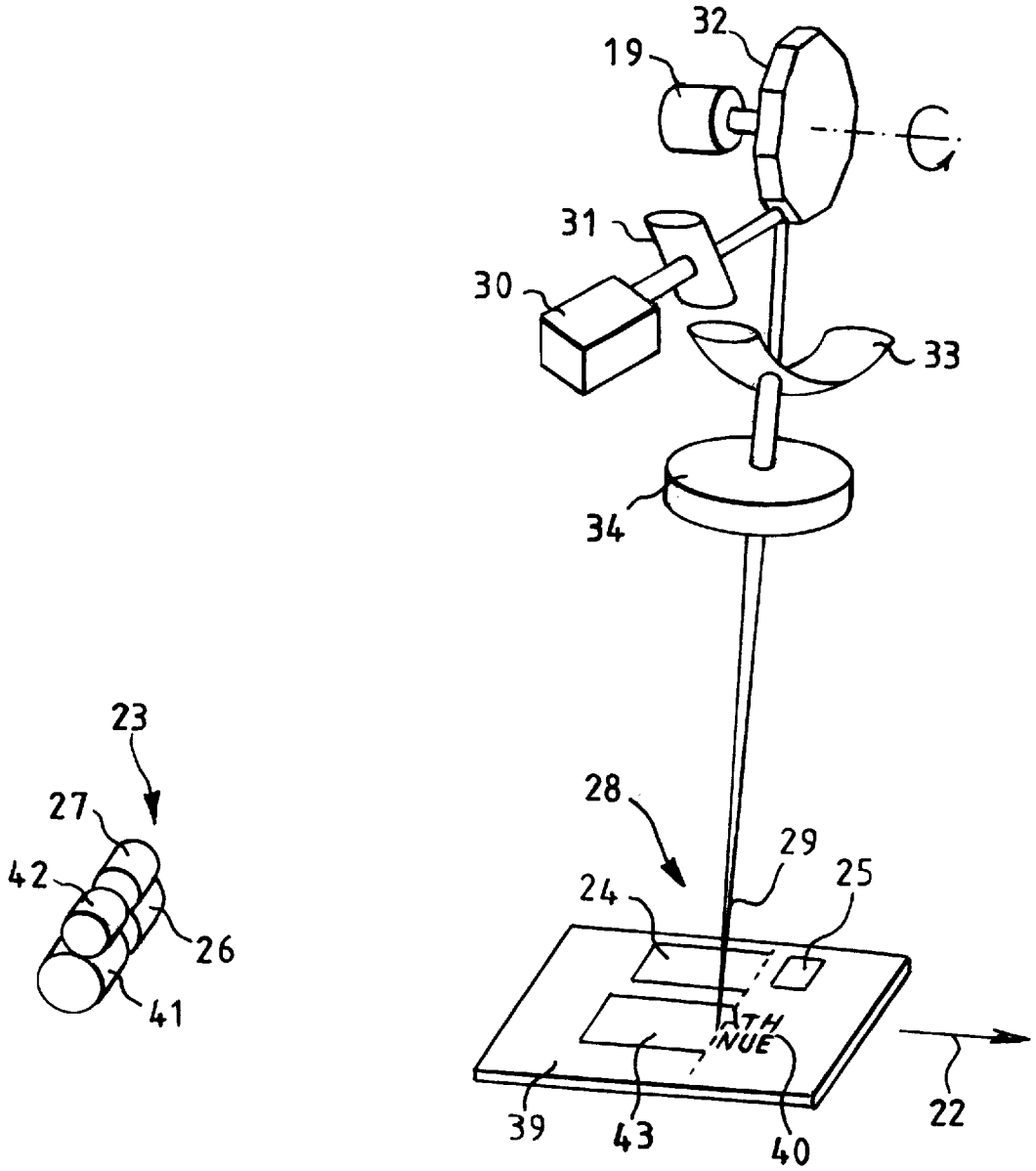
FIG. 2 illustrates a printer of the postage meter.

The printing station 20 for forming a franking impression on the mail items is illustrated in more detail in FIG. 2, to which reference will now be made. A mail item 39 is fed through the print station by feeding means (not shown) driven by one or more motors 18. The feeding means may comprise transport belts or rollers operative to engage the mail and to feed the mail item in the direction of arrow 22. Initially in the printing station, the mail item is fed through an inking zone 23 where ink is deposited on the mail item in an area 24 of the mail item encompassing a location in which it is desired to form a franking indicium or impression 25. The ink is applied to the mail item by means of an ink transfer roller 26 receiving ink from an inking roller 27. The width of the rollers 26, 27 is chosen such as to deposit an area 24 of ink of the required height on the mail item. If desired differently coloured inks may be applied in separate bands. For example if both a franking indicium 25 and a destination address 40 are to be formed on the mail item, the franking indicium may be formed in one colour, for example red, and the destination address 40 may be formed in another colour, for example black. This may be accomplished by the provision of two sets of rollers, one set 26, 27 being provided to deposit the area 24 of one colour and a second set 41, 42 being provided to deposit an area 43 of a second colour in which the destination address 40 is to be formed. Alternatively a single transfer roller may be provided, the roller having a length sufficient to span both the area in which the franking indicium is to be formed and the area in which the destination address is to be formed. Separate inking rollers roll in contact with different portions of the length of the transfer roller, the inking rollers having widths corresponding to the heights of the areas on the mail item in which the franking indicium and destination address are to be formed.

After receiving the area, or areas of ink, the mail item continues to be fed in the direction of arrow 22 and moves through an ink removal zone 28. In the ink removal zone a beam 29 of laser light is scanned, in a direction transverse to the movement of the mail item in the direction of arrow 22, so as to impinge on and traverse the area 24 or areas 24 and 43 of ink deposited on the mail item. The laser beam 29 is generated from a source 30 and passes through a first correction lens 31 to a polygon mirror 32. The beam is reflected from the mirror 32 and passes through a second correction lens 33 and a focussing lens 34 and thence to the plane in which the upper (as shown in FIG. 2) surface of the mail item lies. The lens 34 is adjusted to provide a desired resolution of the spot size of the laser beam where it impinges on the surface of the mail item. The mirror 32 is rotated by the motor 19 and this rotation of the mirror results in the laser beam being scanned across the surface of the mail item. The rate of the scanning is determined by the rotational speed of the mirror 32. Accordingly the rotational speed of the mirror 32 and the linear movement of the mail item in the direction of arrow 22 are selected such that each scan of the laser beam traverses a strip of the mail item immediately adjacent to a strip traversed in a preceding scan. The speed of feeding of the mail item, relative to the rotational speed of the mirror 32 is such that the strips of the mail item scanned by the laser beam adjoin and may overlap to a small extent to ensure that the whole surface of the areas of ink deposited on the mail item are scanned by the laser beam during feeding of the mail item through the ink removal zone of the printing station.

The laser beam source 30 is switched on and off under the control of the microprocessor by print signals on line 35 (FIG. 1). When the laser beam impinges on the ink deposited on the mail item, the impingement of the laser beam results in heating of the ink to an extent sufficient to remove the ink from the surface of the mail item. The laser source is switched on at those times when the laser beam is scanned across and impinges on those parts of the areas of ink required to be removed. The laser source is switched off at those times when the laser beam is scanned across and impinges on those parts of the areas of ink required to be retained to form a required franking indicium 25 or destination address 40. The laser is pulsed on and off by strobe pulses on line 36 (FIG. 1) at a rate to provide a desired resolution in the direction of the transverse scans. The rate is such that successive pulsing on of the laser source results in the laser beam impinging on a series of adjacent dot areas of the mail item. Preferably adjacent dot areas adjoin and may overlap to a small extent.

Electrical power for the postage meter including the laser source 30 is derived from a power supply 37 which receives input of electrical power from a mains power supply.

It will be understood that printing of the franking indicium and, where desired, the destination address is accomplished by depositing an area of ink of sufficient extent to encompass the required indicium and destination address and then selectively removing ink from portions of the area such as to leave deposited on the mail item ink forming the franking indicium and destination address.

While it is envisaged that the franking indicium formed on a mail item comprises a pattern of ink remaining on the mail item after removal of unwanted ink and is of the same visual appearance as franking indicia printed by known franking machines using rotary drum or thermal ink transfer printers, it is to be understood that the franking indicium may be a reverse or negative pattern. In such a reverse or negative pattern, the pattern of the franking indicium consists of a pattern of areas from which ink has been removed lying within an overall area of ink on the mail item.

I claim:

1. A postage meter including electronic accounting and control means and indicium pattern forming means operable by said electronic accounting and control means to form a required franking indicium on a mail item; said indicium pattern forming means including means to deposit an area of ink on the mail item and laser means operable to remove portions of said area of ink to leave ink forming the required franking indicium on the mail item.

2. A postage meter as claimed in claim 1 wherein the ink depositing means is operable to deposit an area of ink of sufficient extent to permit formation therein of a franking indicium and a destination address on the mail item.

3. A postage meter as claimed in claim 1 wherein the ink depositing means includes first depositing means operable to deposit a first area of ink to permit formation therein of a franking indicium and second depositing means to deposit a second area of ink to permit formation therein of a destination address or other information.

4. A postage meter as claimed in claim 3 wherein the first means is operable to deposit ink of a first colour and the second means is operable to deposit ink of a second colour different from said first colour.

5. A postage meter as claimed in claim 1 wherein the laser means includes a source to generate a laser beam and means to scan the laser beam to traverse the area of ink in a series of scanning traverses; said laser source being switched on and off by the electronic accounting and control means such that the laser source is switched on to generate the laser beam to impinge, during scanning traverses of the laser beam, on the portions of the area of ink to be removed and the laser source is switched off during times when otherwise the laser beam would impinge on ink of the area required to remain and form the indicium.

6. A postage meter as claimed in claim 5 wherein the ink depositing means is operable to deposit an area of ink of sufficient extent to permit formation therein of a franking indicium and a destination address on the mail item.

7. A postage meter as claimed in claim 5 wherein the ink depositing means includes first depositing means operable to deposit a first area of ink to permit formation therein of a franking indicium and second depositing means to deposit a second area of ink to permit formation therein of a destination address or other information.

8. A postage meter as claimed in claim 7 wherein the first means is operable to deposit ink of a first colour and the second means is operable to deposit ink of a second colour different from said first colour.

9. A method of forming a franking indicium on a mail item including the steps of depositing an area of ink on a surface of the mail item; and subjecting the area of ink to an ink removal step in which unwanted ink is removed from the surface of the mail item to leave a franking indicium remaining on the surface of the mail item.

10. A method as claimed in claim 9 wherein the ink is removed from the area of ink to leave a destination address on the surface of the mail item.

11. A method as claimed in claim 9 wherein in the ink removal step, portions of the area unwanted ink are subjected to the action of a laser beam effective to heat the ink to an extent sufficient to remove the unwanted ink.

12. A method as claimed in claim 11 wherein the ink is removed from the area of ink to leave a destination address on the surface of the mail item.

* * * * *